US007137754B2

(12) United States Patent
Van Der Poel

(10) Patent No.: US 7,137,754 B2
(45) Date of Patent: Nov. 21, 2006

(54) ROAD MARKING SYSTEM

(75) Inventor: Lucas Leo Desiree Van Der Poel, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 52 days.

(21) Appl. No.: 10/531,607

(22) PCT Filed: Oct. 1, 2003

(86) PCT No.: PCT/IB03/04324

§ 371 (c)(1),
(2), (4) Date: Apr. 14, 2005

(87) PCT Pub. No.: WO2004/035935

PCT Pub. Date: Apr. 29, 2004

(65) Prior Publication Data

US 2006/0029466 A1 Feb. 9, 2006

(30) Foreign Application Priority Data

Oct. 18, 2002 (EP) ..... 02079403
Feb. 5, 2003 (EP) ..... 03100242

(51) Int. Cl.
*E01F 9/053* (2006.01)

(52) U.S. Cl. ..... 404/11; 404/9; 362/153.1

(58) Field of Classification Search ..... 404/6, 404/9, 11–16, 22–24; 256/1, 13.1; 362/145, 362/153, 153.1
See application file for complete search history.

(56) References Cited

U.S. PATENT DOCUMENTS 3,550,077 A * 12/1970 Gilbert ..... 340/905
4,080,085 A * 3/1978 Dickson ..... 404/14
4,595,312 A * 6/1986 Corless ..... 404/11
5,487,619 A * 1/1996 Winebrenner ..... 404/6
5,681,128 A * 10/1997 Morgan et al. ..... 404/12
5,848,837 A * 12/1998 Gustafson ..... 362/235
6,459,218 B1 * 10/2002 Boys et al. ..... 315/324
6,866,394 B1 * 3/2005 Hutchins et al. ..... 362/192
2001/0017775 A1 * 8/2001 Reinert ..... 362/153
2002/0006313 A1 * 1/2002 Pas ..... 404/13
2002/0008973 A1 * 1/2002 Boys et al. ..... 362/307

FOREIGN PATENT DOCUMENTS

NL 1006641 C * 1/1999

* cited by examiner

*Primary Examiner*—Thomas B. Will
*Assistant Examiner*—Alexandra Pechhold

(57) ABSTRACT

A road-marking system has at least a first lighting module (4) provided in a road surface (1). The lighting module (4) is provided with a plurality of light emitting surfaces (14, 14', . . . ). The lighting module (4) has connection means (7, 7) for providing electrical connection between the lighting module (4) and the electrical current supply conductor (6). Preferably, the current supply conductor (6) is provided in a duct (8) provided with an opening (8') at the location of the lighting module (4).

10 Claims, 4 Drawing Sheets

ROAD MARKING SYSTEM

BACKGROUND OF THE INVENTION

The invention relates to a road marking system.

The invention further relates to a lighting module for use in a road marking system, a road surface provided with a road marking system, and a method of manufacturing a road marking system.

Such road marking systems are used in traffic guidance systems for marking paths to be followed by means of transport, such as roads for cars and other road users and runways for airplanes. One of the methods used by traffic planners in their efforts to reduce traffic jams is a so-called tidal flow system. In such a dynamic system, the direction of the traffic on multilane roads is changed in one or several lanes in accordance with the direction of the main flow of traffic. In an alternative embodiment, the number of lanes available for traffic moving in a certain direction is increased or decreased in dependence on the amount of traffic offered. It is a problem in these methods to indicate the direction of the desired traffic flow for a certain traffic lane in a flexible manner, or to change the subdivision of the road in a flexible manner. Known means for indicating the desired direction of the traffic flow comprise signaling lights next to or above the road.

Said road marking systems may have static applications in addition to their use as dynamic road marking systems. Static applications of road marking systems comprise the markings of portions of roads (for example straight portions or bends) which direct the traffic under certain weather conditions, for example during fog, rain, iciness, etc., and/or under certain lighting conditions, for example daylight, twilight, low position of the sun, night, etc.

Road marking systems may be provided in a road surface of the road, but also next to and/or above the road, for example on a crash barrier next to the road.

The principle of dynamic road marking is described in WO-A 00/020691 (PHN 17.533). This road marking system utilizes light emitted in the direction of the road user (driver), for example for realizing a flexible driving lane arrangement. A seemingly continuous (white) line is realized in that light dots present in a lighting module are placed at suitable distances from one another and are switched on. The impression of a continuous line is created because the road user perceives the road surface from a certain distance and at an angle. Switching on and off of the light in segments changes a dotted or interrupted line into a closed or continuous line marking. Such segments are, for example, three metes long, for example comprising twelve lighting modules with mutual spaces of approximately 25 cm. Thus, for example, segments of said length may be switched such that only one out of every four segments is burning, so that a broken line with the length of one segment followed by three times the length of one segment without light each time is created. A seemingly continuous (white) line is visible if all segments are switched on. It is also possible to move the lines through a suitable switching on or off of a line. In this manner, a normal two-lane road segment may be transformed into, for example, a road with three narrowed driving lanes (possibly in combination with a reduced maximum speed). Such road marking systems dynamically increase the capacity of an existing road. The lighting modules may also be used for alternative applications in which the mutual distances between the lighting modules are variable. Thus it is also possible, for example, to displace the lines (seemingly) in that a strip is switched on and off in a suitable manner.

WO-A 00/020691 and WO-A 01/92641 describe various embodiments of lighting modules which are also provided in the road surface. WO-A 01/92641 describes a sawcut arrangement for providing (electrical) supply and control cables in which sawcuts are provided which extend in longitudinal direction in the road surface. In this case an approximately 2.5 cm wide cable duct is sawn into the surface of the road to a depth that varies between 3 and 10 cm. The cable or cables is or are laid in such a cable duct, which is usually filled at the upper side with road metal or fine gravel. At the road surface level, the cable duct is usually closed by means of a bituminous or concrete-type substance. WO-A 01/92641 further describes lighting modules in the form of half discs into which the cable is introduced adjacent the surface of the road.

SUMMARY OF THE INVENTION

It is among the disadvantages of such cable ducts that the service life of such known cable ducts is usually shorter than the service life of the road surface. Furthermore, the Gown cable ducts may constitute an increased risk for motorcyclists because the texture of the surface of the cable duct in the road surface differs from that of the remainder of the road surface, which may adversely affect the friction of the road surface. In addition, the difference in texture will make an undesirable visual line observable.

It is an object of the invention to provide a road marking system in which the above disadvantage is counteracted wholly or in part. According to the invention, a road marking system of the kind mentioned in the opening paragraph for this purpose comprises at least one lighting module provided in a road surface, which lighting module is provided with coupling means for coupling an electrical conductor provided in the road surface and the lighting module to one another.

Since the lighting module is provided with coupling means, the electrical conductor can be mounted in the road surface before the lighting module is provided. The coupling means are used during mounting of the lighting module in the road surface for achieving the (electrical) connection between the electrical conductor and the lighting module. The measure according to the invention implies that a recess is provided in the road surface exclusively at the area of the lighting module to be mounted, for example through the application of a suitable sawcut. Before the lighting module is provided in the recess, the coupling means achieve the electrical connection between the lighting module and the electrical conductor. The electrical conductor is preferably provided at an earlier stage, for example in a cable duct in a portion that is situated at a lower level in the road covering. Since the electrical current conductor is situated deeper inside the road, a higher (covering) layer of the road may be provided without the heat that is evolved during the provision of asphalt causing damage to the electrical conductor.

A further advantage of the use of coupling means is that the coupling means can be detached in a simple manner when maintenance, repairs, or replacement of the road surface and/or of the lighting module is being carried out. The use of the coupling means makes an excess length available which is necessary for lifting the lighting module from the road surface so as to disconnect the coupling means, which are joined to the lighting module, for example, by means of a (plug-in) connector. The result of this is that a replacement action, for example for replacing (damaged) lighting modules, requires comparatively little time, so that the road capacity remains available.

There is no (undesirable) visual disturbance of the road surface owing to the absence of the cable duct. A recess is made in the road surface at the areas of the lighting modules only. Additional noise caused by running wheel contacts is considerably reduced thereby.

Since the electrical conductor or conductors in the known road marking system lies or lie close to the surface of the road, there is usually an increased risk of mechanical damage to the electrical current conductor or conductors, especially in the case of damage to the road surface, for example owing to accidents. An example is a truck with an exploding tyre whose naked wheel may cut a deep furrow into the asphalt surface.

A preferred embodiment of the road marking system is characterized in that the electrical conductor is provided in a cable duct which is provided with an opening for the passage of the coupling means at the area of the lighting module. The cable duct is interrupted at the area of the lighting module in the known road marking system. The use of a continuous cable duct in this embodiment of the invention renders it practicable to provide the cable duct in the road at an earlier stage. All that remains is to provide an opening in the cable duct at the area of the lighting module to be provided. The shape of the cable duct may vary from rectangular to circular.

A favorable embodiment of the road marking system is characterized in that the road surface comprises a first asphalt layer and a second asphalt layer situated below the first, the cable duct being provided in said second asphalt layer. The first asphalt layer (top layer) need not be damaged for the purpose of providing the cable duct. It suffices to provide a recess, for example in the shape of a half disc, in the road surface at the area of each lighting module. Preferably, the machine necessary for making the recess for the lighting module cuts through the continuous cable duct at its deepest point. The cable may be introduced into the lighting module through the opening thus created. The coupling means provide the electrical connection between the lighting module and the electrical conductor.

An additional advantage of the road marking system according to the invention is an improvement in the water handling in so-called open-pore asphalt concrete roads. In this case the first asphalt layer preferably comprises the open-pore asphalt concrete mixture. The drainage of rainwater to the side of the road in a road surface provided with an open-pore top layer by means of fall takes place inside the open-pore construction owing to the open structure of the asphalt mixture. According to the invention, the provision of a cable duct in the road surface for accommodating the electrical conductor is avoided, so that the water drainage capacity of the open-pore layer to the side of the road is only slightly influenced at the area of the lighting module. Since the water removal can take place below the road surface, less water will be splashed upwards by passing car tyres, which leads to an improved vision and comfort for the road user. The provision of the cable duct below the open-pore top layer has a favorable influence on the water drainage of the road surface.

The invention further relates to a lighting module for use in a road marking system according to the invention and a road surface provided with a road marking system according to the invention.

The invention further relates to a method of manufacturing a road marking system. According to the invention, a method of manufacturing a road marking system comprises the following steps. First at least one electrical conductor is provided in a road surface. Then at least one lighting module is provided in the road surface, whereupon the lighting module and the electrical conductor are connected to one another. The coupling means are used during mounting of the lighting module in the road surface for achieving the (electrical) connection between the electrical conductor and the lighting module. The measure according to the invention achieves that a recess is cut into the road surface at the area of the lighting module to be mounted only.

Preferably, the electrical conductor is provided in a cable duct which is provided with an opening for the passage of the coupling means at the area of the lighting module. The use of a continuous cable duct renders it practicable to provide the cable duct in the road system at an earlier stage. An opening is made in the cable duct only at the area of the lighting module to be provided. The shape of the cable duct may vary from rectangular to circular.

A preferred embodiment of the road marking system is characterized in that a sawcut is provided in the road surface for accommodating the lighting module in the road surface, the cable duct being provided with said opening before the lighting module is mounted. Preferably, the opening in the cable duct is created while the sawcut is being provided in the road surface.

BRIEF DESCRIPTION OF THE DRAWINGS

The invention will now be described in more detail with reference to a number of embodiments and a drawing, in which:

The Figures are purely diagrammatic and not drawn to scale. Some dimensions are particularly exaggerated for greater clarity. Similar components have been given the same reference numerals as much as possible in the Figures.

FIG. 1A is a diagrammatic cross-sectional view of a cable duct 8 provided in a road surface 1. The road surface 1 comprises a first asphalt layer 2 and a second asphalt layer 3 situated below the first. In the example of FIG. 1A, the cable duct 8 is provided in the second asphalt layer 3. The first asphalt layer 2 in FIG. 1A comprises so-called open-pore asphalt concrete. The second asphalt layer 3 is also denoted the foundation layer.

Figure 1A:
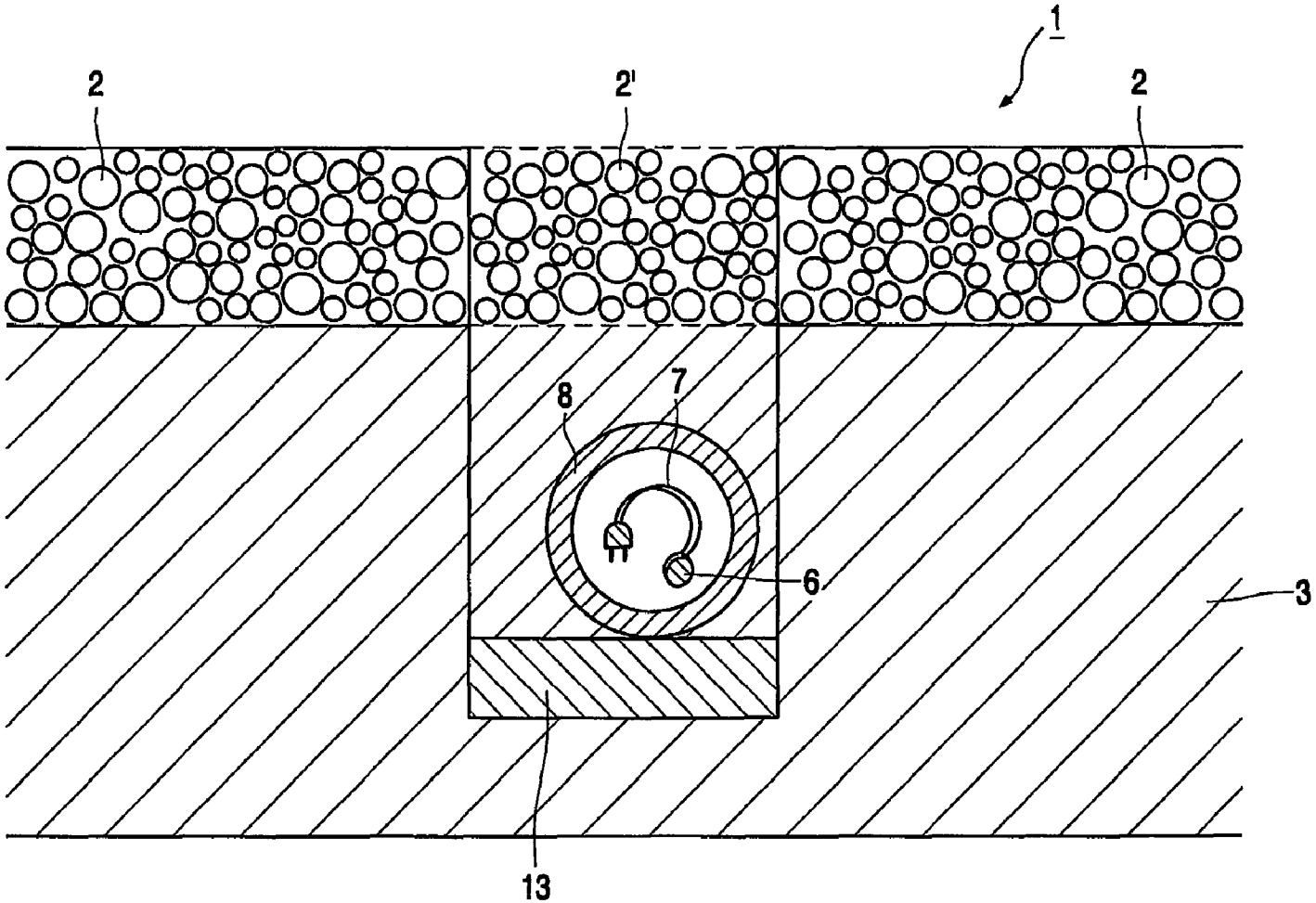
FIGS. 1A to 1C show the steps in the process of providing a road marking system according to the invention, comprising at least one lighting module, in a road surface in cross-section.

The cable duct 8 is provided in an existing road surface 1 in the following manner. First the existing road surface 1 is removed at the area of the cable channel to be provided. This may be done in that the first asphalt layer 2 is removed over the full width of the road surface 1, or in that the first asphalt layer 2 is removed over a width of approximately 10 to 20 cm. A sawcut is for this purpose made in longitudinal direction of the road surface 1 on either side of the location where the cable channel is provided, whereupon the asphalt therebetween is removed. Then the groove for the cable duct 8 is made in the second asphalt layer 3.

Subsequently, the cable duct 8 is laid in the second asphalt layer 3 of the road surface 1 on a planarized grit bottom 13. The cable duct 8 preferably comprises a flexible tube of comparatively great length, or is built up from a number of elements that are coupled together. Dilatation seams may be added for accommodating expansion and settling differences. Then the duct groove is filled up again, preferably with a stony material, preferably up to the upper surface of the second asphalt layer 3. Dilatation seams may again be added here. Then a new top layer of asphalt 2' is provided, preferably again made of open-pore asphalt concrete. In the case of a new road surface 1, the cable duct 8 is provided in the second asphalt layer 8 immediately during construction of the road.

Figure 1B:
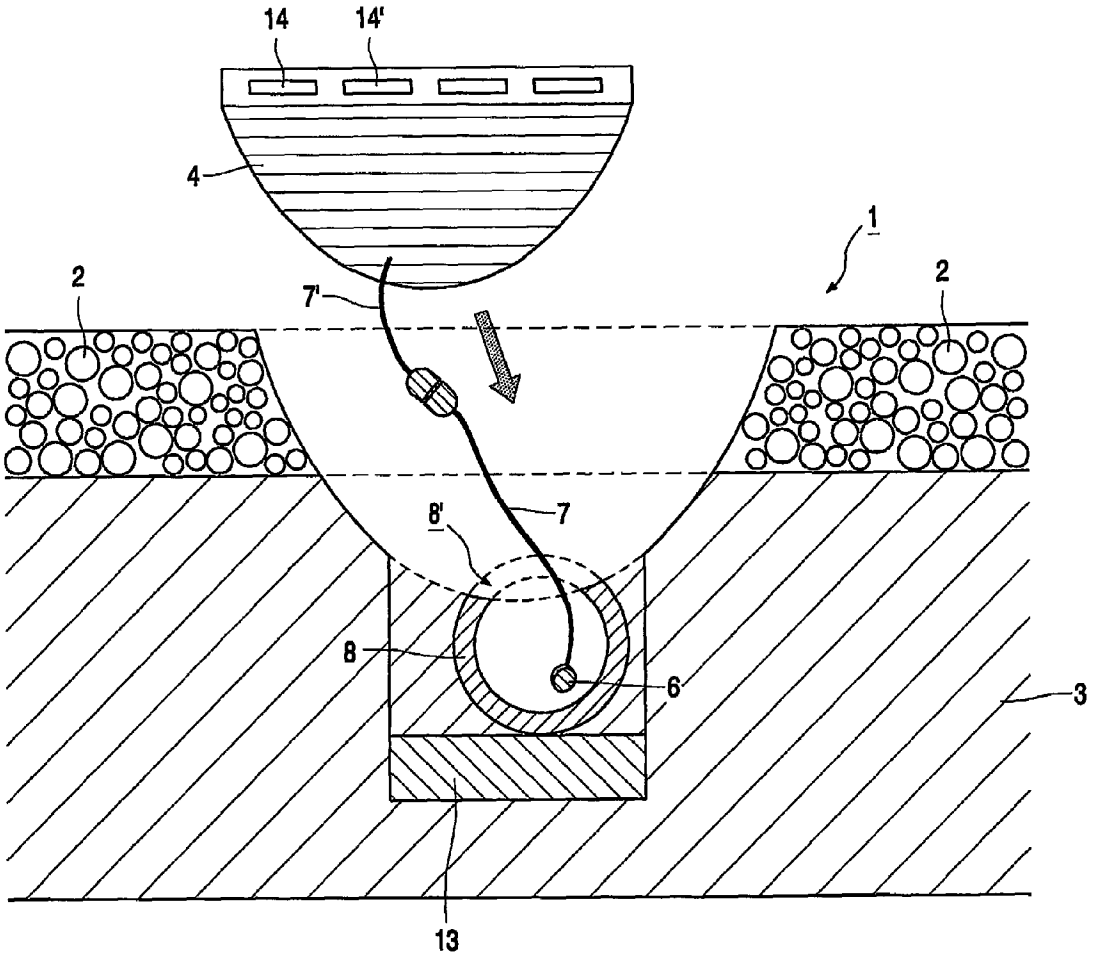

In a next step, recesses are sawn into the road surface for accommodating the lighting modules. FIG. 1B shows a sawcut provided in the road surface 1 and a lighting module 4 provided with emission windows 14, 14', . . . for the emission of light. The sawcut is obtained, for example, by means of a circular saw, a cutter, or a grinding disc. This creates a recess in the road surface in the form of half a round disc. In the example of FIG. 1B, the semi-circular lighting module 4 has not yet been mounted in the sawcut. The circular saw sinks perpendicularly downwards until a recess of the desired depth (dimensions) has been obtained. At the deepest point of the recess, the circular saw also cuts through the upper side of the cable duct 8, such that an opening 8' is obtained in the cable duct 4 through which a cable can be passed.

An electrical conductor 6 provided with coupling means 7 is provided in the cable duct 8 for coupling the lighting module 4 and the electrical conductor 6 to one another. The electrical conductor 6 may have been previously provided with a plurality of coupling means 7 which are provided at suitable mutual distances on the electrical conductor 6. In an alternative embodiment, a main cableform is used which has branch-offs to lighting modules at suitable distances. From such a lighting module, (secondary) coupling cables are connected through to the subsequent lighting modules. In an alternative embodiment, the lighting modules may be connected through without a main cable. The branch-off cables and (secondary) coupling cables may be simply guided through the cable duct 8, and may also be picked up from the cable duct in a simple manner through the recesses for the lighting modules.

In a subsequent step, an electrical connection is made between the lighting module 4 and the electrical conductor 6 by the coupling means 7, 7'. In the example of FIG. 1B, the electrical conductor 6 is provided with coupling means 7 and the lighting module 4 with coupling means 7', the connection being achieved by means of a male and female plug. In an alternative embodiment, the plugs are absent and the lighting module only is provided with coupling means, which are directly connected to the electrical conductor 6.

Figure 1C:
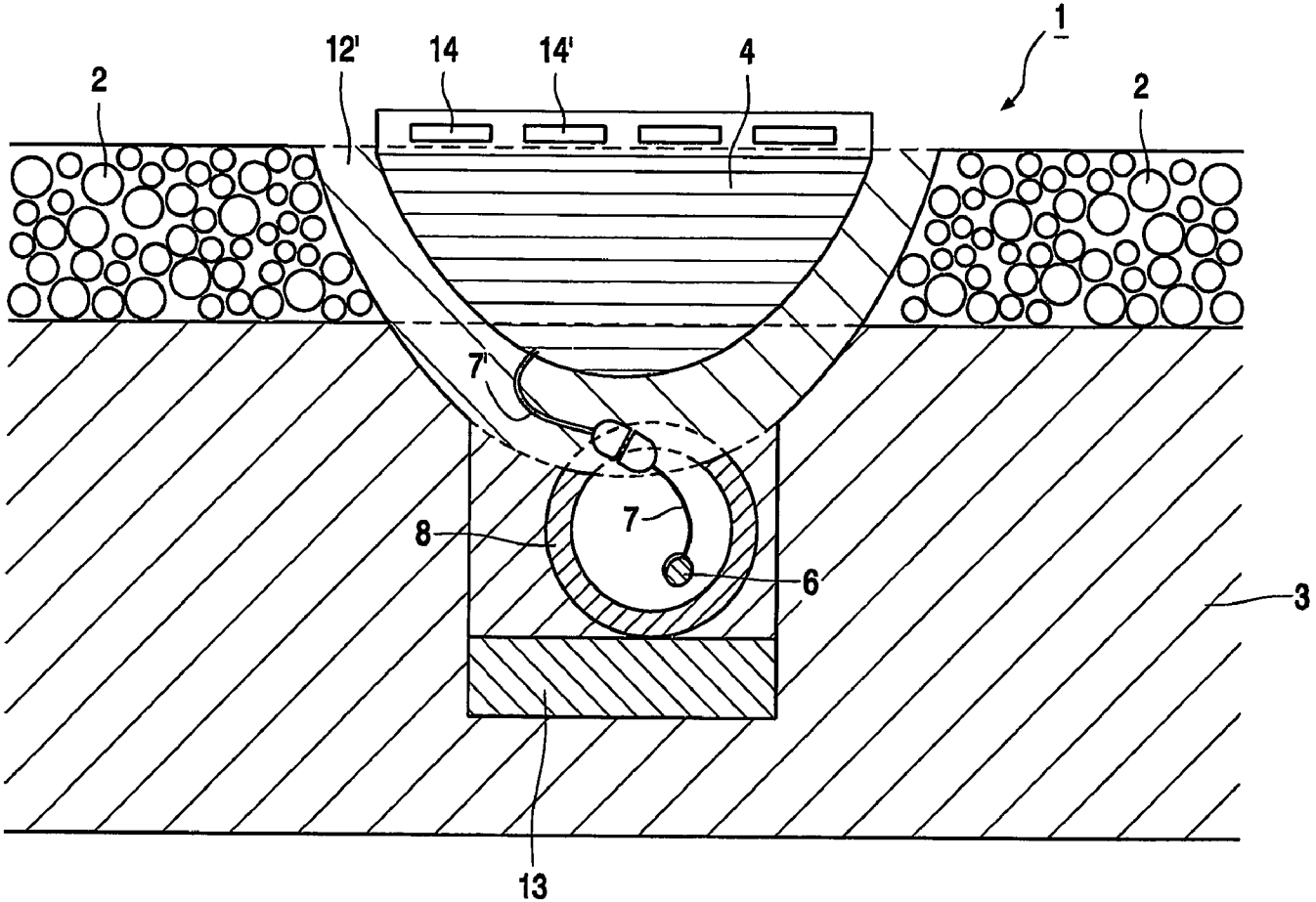

In a final step, the lighting module 4 is provided in the road surface 1. An adhesive connection 12' is preferably used so as to obtain the desired retention of the lighting module in the road surface, see FIG. 1C.

Figure 2:
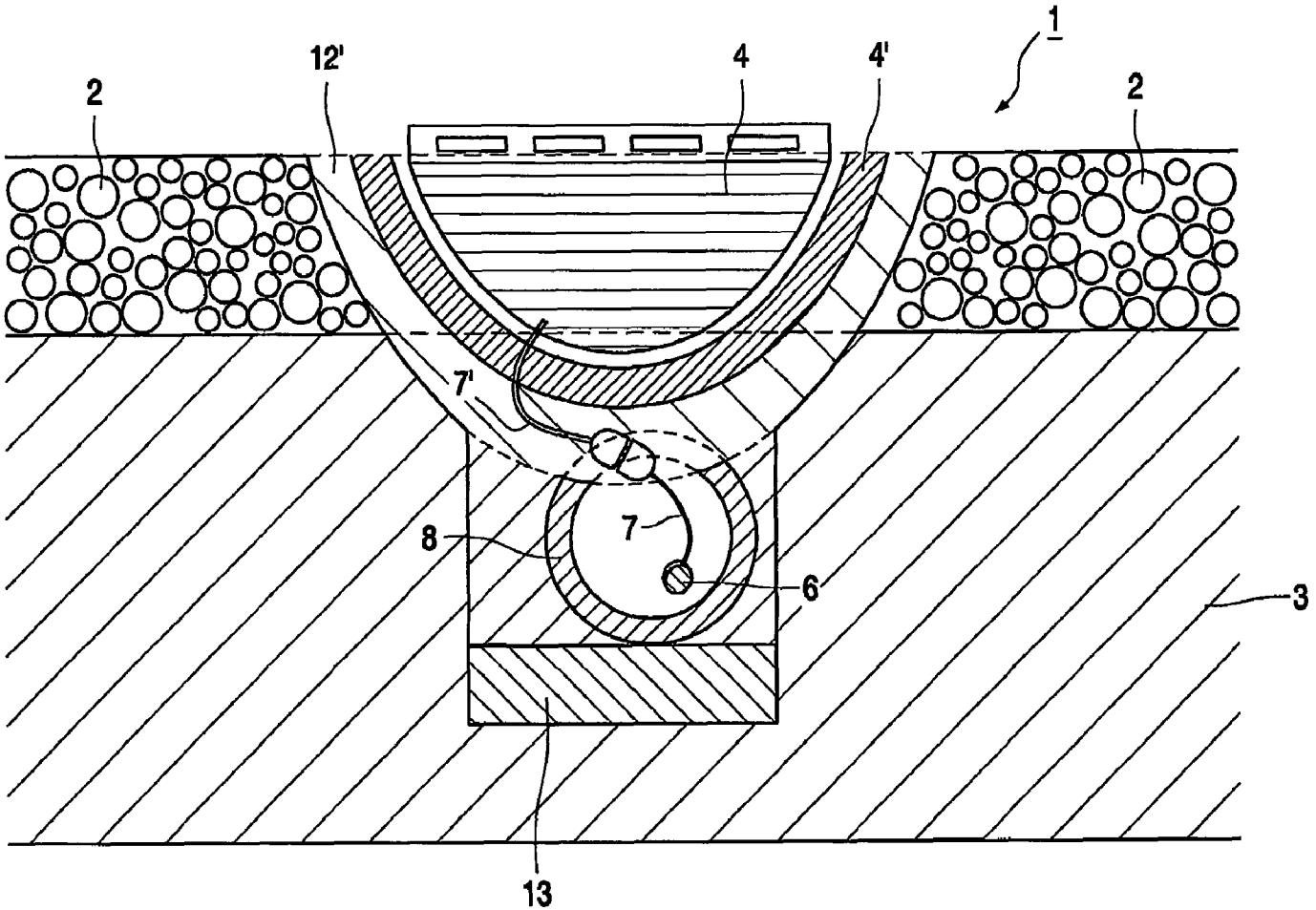
FIG. 2 shows an alternative embodiment of the road marking system in cross-section.

FIG. 2 shows an alternative embodiment of the road marking system. The lighting module 4 in this embodiment is mounted in a housing 4'. The housing 4' is anchored in the road surface 1 by means of an adhesive connection 12'. The lighting module 4 is preferably detachably fastened in the housing 4'.

The cable entry into the lighting module is preferably watertight (IP68 class). Furthermore, the lighting module may be made airtight at the upper side, so as to achieve that the coupling means remain dry.

It will be obvious that many variations are possible to those skilled in the art within the scope of the invention. The scope of protection of the invention is not limited to the embodiments given above. The invention resides in each novel characteristic and each combination of characteristics. Reference numerals in the claims do not restrict the scope of protection thereof. The use of the verb "comprise" does not exclude the presence of elements other than those mentioned in the claims. The use of the indefinite article "a" or "an" preceding an element does not exclude the presence of a plurality of such elements.

The invention claimed is:

1. A road marking system comprising at least one semi-circular lighting module (4) provided in a recess in a road surface (1), wherein the recess is in the form of half a round disc, wherein the road surface (1) comprises a first asphalt layer (2) and a second asphalt layer (3) situated below the first asphalt layer (2), wherein the lighting module (4) is provided with coupling means (7,7') for coupling an electrical conductor (6) and the lighting module (4) to one another, wherein the electrical conductor (6) is provided in a cable duct (8) provided in the second asphalt layer (3) of the road surface (1), and wherein the coupling means (7,7') includes a cable for coupling the lighting module (4) to the electrical conductor (6), the cable extending through an opening in an upper side of the cable duct (8), wherein a deepest point of the half a round disc shared recess provides the opening in the cable duct (8) through which the cable can be passed, and wherein provision of the cable duct (8) below the first asphalt layer (2) provides an additional avenue for water drainage of the road surface.

2. A road marking system as claimed in claim 1, wherein the first asphalt layer (2) comprises open-pore asphalt concretes, wherein a water drainage capacity of the open-pore asphalt to a side of the road surface is only slightly influenced at the area of the lighting module.

3. A lighting module (4) for use in a road marking system as claimed in claim 1.

4. A road surface (1) provided with a road marking system as claimed in claim 1.

5. A method of manufacturing a road marking system as claimed in claim 1, comprising the steps of: providing at least one electrical conductor (6) in a road surface (1); providing at least one lighting module (4) in the road surface (1); and connecting the lighting module (4) and the electrical conductor (6) to one another.

6. A method as claimed in claim 5, characterized in that a sawcut is provided in the road surface (1) for the accommodation of the lighting module (4) in the road surface (1), the cable duct (8) being provided with the opening (8') before the lighting module is mounted.

7. A method as claimed in claim 6, characterized in that the opening (8') in the cable duct (9) is created while the sawcut is being provided in the road surface (1).

8. A road marking system as claimed in claim 1, wherein the electrical conductor (6) is provided with a first coupling means (7) and the lighting module (4) is provided with a second coupling means (7'), and wherein connection between the first coupling means (7) and the second coupling means (7') is achieved by means of a male and female plug.

9. A road marking system as claimed in claim 8, further wherein the cable of the coupling means (7,7') is of a length sufficient for lifting the lighting module (4) from the road surface (1) so as to enable disconnecting of the coupling means (7,7').

10. A road marking system as claimed in claim 1, wherein the cable of the coupling means (7,7') is of a length sufficient for lifting the lighting module (4) from the road surface (1) to enable disconnecting of the coupling means (7,7').

* * * * *